US005298007A

United States Patent [19]

Achelpohl et al.

[11] Patent Number: 5,298,007

[45] Date of Patent: Mar. 29, 1994

[54] METHOD AND APPARATUS FOR MANUFACTURING CARRIER BAGS OF PAPER

[75] Inventors: Fritz Achelpohl, Lengerich/Westf; Friedhelm Brinkmeier, Lengerich; Aloys Winnemoeller, Rheine; Wilfried Lotz, Lengerich, all of Fed. Rep. of Germany

[73] Assignee: Windmöller & Hölscher, Lengerich/Westf, Fed. Rep. of Germany

[21] Appl. No.: 866,643

[22] Filed: Apr. 13, 1992

[30] Foreign Application Priority Data

May 8, 1991 [DE] Fed. Rep. of Germany ..... 4115161

[51] Int. Cl.[5] ..... B31B 29/86; B31B 31/86

[52] U.S. Cl. ..... 493/226; 493/926

[58] Field of Search ..... 493/221, 226, 345, 926

[56] References Cited

U.S. PATENT DOCUMENTS

| | | | |
|---|---|---|---|
| 3,392,636 | 7/1968 | Lindley | 493/926 |
| 3,850,724 | 11/1974 | Lehmacher | 493/226 |
| 3,857,329 | 12/1974 | Lehmacher et al. | 493/926 |
| 3,865,018 | 2/1975 | Gaffney | 493/926 |
| 4,018,142 | 4/1977 | Canno | 493/226 |
| 4,362,526 | 12/1982 | Wilson | 493/226 |
| 4,854,931 | 8/1989 | Roberts et al. | 493/226 |

*Primary Examiner*—William E. Terrell
*Attorney, Agent, or Firm*—Keck, Mahin & Cate

[57] ABSTRACT

In a method for manufacturing carrier bags of paper with paper handles glued to the outside in a continuous working cycle, firstly, in a bag machine, carrier bags without handles are manufactured. Paper handles are glued to the carrier bags in a handle application unit. The carrier bags are fed from the bag machine with the bottoms leading to the handle application unit. After the handles have been glued to the bags, the bags are removed, again with the bottoms leading.

9 Claims, 2 Drawing Sheets

METHOD AND APPARATUS FOR MANUFACTURING CARRIER BAGS OF PAPER

BACKGROUND OF THE INVENTION

This invention relates to a method and apparatus for manufacturing carrier bags of paper with paper handles glued to the outside. In particular, the bags are made in a continuous working cycle in a bag machine wherein first, bags without handles are made, and the handles are then glued to the bags in a handle application unit.

It is common practice to make paper bags without handles, which are then collected into bundles. In order to provide such bags with paper handles, a machine is used, for example as disclosed in De-PS 11 52 602, to which reference is made here expressly. This machine is shown in FIG. 1. The machine is additionally provided with a known bag feeder, which is represented on the right in FIG. 1. From a bag bundle 21, individual bags 23 are placed on a feeding belt 24 by means of a feeder 22, in such a way that the individual bags 23 placed on the belt 24, are moved with their open ends 25 leading, to a handle unit 26, where the handles are glued onto the bags. The finished carrier bags are moved away with the hand end leading and are placed on a stack 27. The details are described in the DE-PS 11 52 602, the contents of which is incorporated herein by reference.

The system disclosed in DE-PS 11 52 602 and represented in FIG. 1 can, however, only be operated with a relatively low frequency, because in the case of too fast a movement of the bags from the feeder 23 to the handle unit 26 and from the handle unit 26 to the stack 27, air would get into the bags, so that further processing would become difficult or impossible. A further disadvantage of the known device consists in the fact that the individual bags emerge from the machine or the handle unit 26 with the attached handle 28 ahead, so that a neatly aligned placing of the bags in part becomes extremely difficult.

SUMMARY OF THE INVENTION

In view of the above, it is an object of the invention to provide a method for manufacturing paper bags with a handle glued to the outside, in one operating cycle, continuously, and with a high frequency. It is a further object to provide an apparatus for carrying out such method.

In accordance with the invention in the method indicated above, the carrier bags of paper are fed from the bag machine to the handle application unit with the bottom of each bag leading, and are moved away with the bottom leading after the paper handles have been attached. Firstly, individual bags are made without carrying handles, which after being manufactured, without further temporary stacking, are fed, with their bottom ends leading, from the bag machine to a handle unit, and after the carrying handles have been glued thereto are moved away with the bottoms leading.

Preferably, paper handles are made in a handle unit and are fed to the handle application unit. The handle unit and the handle application unit are known per se from DE-PS 11 52 602.

Preferably, the carrier bags of paper are pressed while they are moved away. After the carrying handles have been glued thereto, the carrier bags are moved away with the bottoms leading and are pressed in the process. Subsequently, the individual bags can be collected. Since the bags are pressed while they are moved away, air that is possibly still present in the bags can be squeezed out, so that on the one hand processing and on the other hand stacking of the bags are simplified considerably.

By means of the inventive method, paper bags with handles glued to the outside can be manufactured in one working cycle, continuously and with a high frequency.

Apparatus for carrying out the method in accordance with the invention comprises a bag machine for manufacturing carrier bags of paper without handles, a handle application unit for gluing paper handles onto the carrier bags, a transport means for feeding the carrier bags with the bottoms leading, from the bag machine to the handle application unit, and a removal means for removing the carrier bags, with bottoms leading, from the handle application unit.

Preferably, there is provided a handle unit for manufacturing paper handles and for feeding the paper handles to the handle application unit. The handle unit and the handle application unit are known per se from the De-PS 11 52 602.

A further advantageous embodiment is characterized by a pressing means for pressing the carrier bags removed by the removal means.

The removal means and/or the pressing means can consist of a pair of pressing belts. The arrangement preferably is chosen such that the pair of pressing belts constitutes both the removal means and the pressing means. As a result, the apparatus is particularly space-saving and efficient.

A further advantageous embodiment is characterized by a transfer station, which preferably consists of a transfer cylinder, for transferring the carrier bags of paper from the bag machine to the transport means.

BRIEF DESCRIPTION OF DRAWINGS

An embodiment of the invention will subsequently be explained in detail by means of the attached drawings, wherein.

DESCRIPTION OF PREFERRED EMBODIMENT

Figure 1:
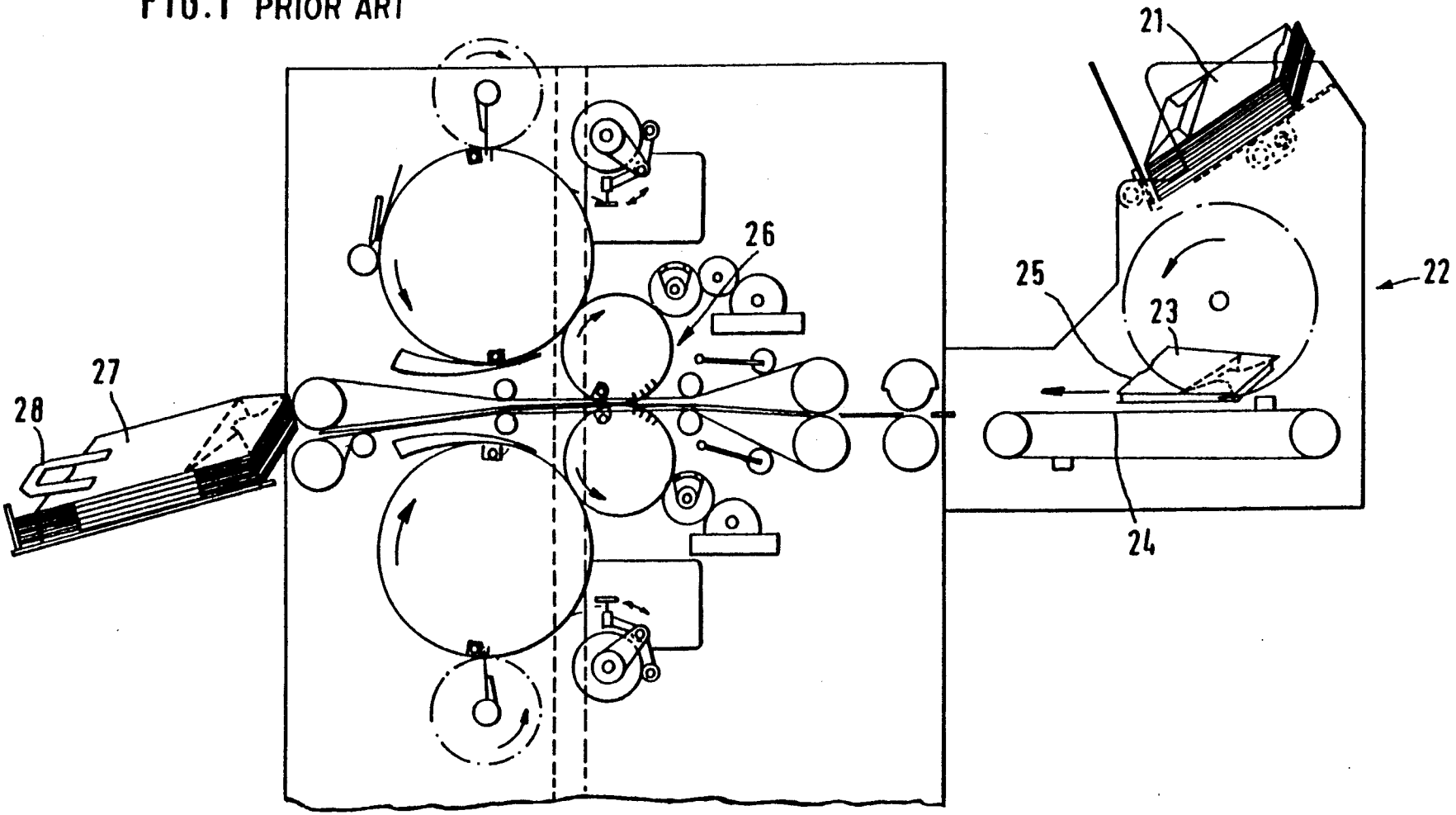
FIG.1 PRIOR ART
FIG. 1 is a diagrammatic view of apparatus for manufacturing carrier bags of paper as disclosed in DE-PS 11 52 602.
Figure 2:
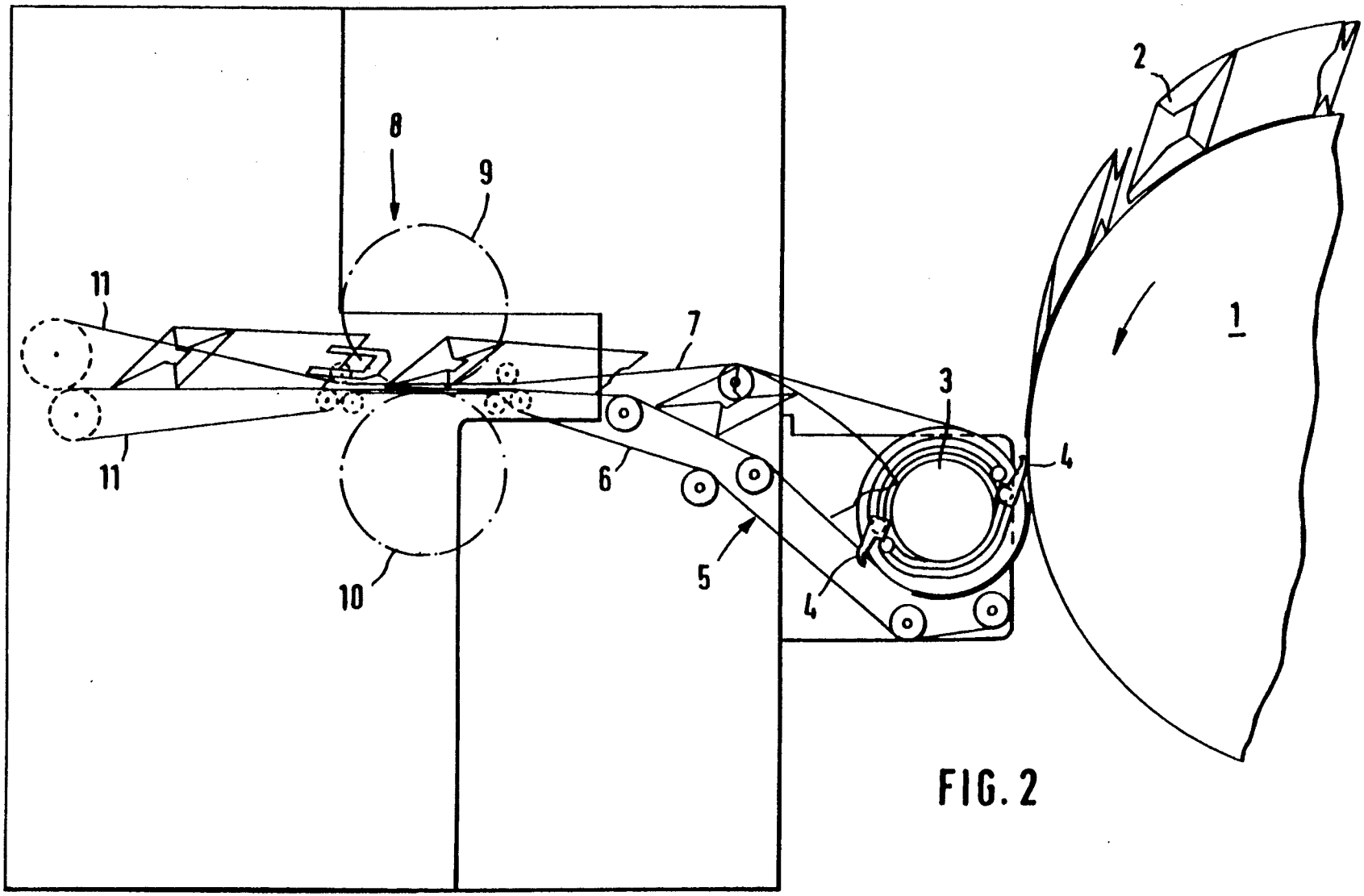
FIG. 2 is a similar view of apparatus in accordance with the invention.

Referring to FIG. 2, 1 designates a bag machine, from which individual paper bags 2 are fed with the bottom ends leading to a transfer cylinder 3. The transfer cylinder 3 comprises grippers 4 for seizing the individual bags and transferring them to a transport means 5. The transport means 5 consists of two pairs of endless belts 6 and 7, so that the individual bags 2 are held between the belts in proper alignment and are fed to a handle application unit 8. The handle application unit 8 is known in its structure from DE-PS 11 52 602, which is incorporated by reference, and substantially consists of two cooperating handle application cylinders 9 and 10, by means of which carrying handles are each glued onto the outsides of the bags at the top of each bag. How the individual handles are formed and fed specifically is disclosed in DE-PS 11 52 602, in particular in FIGS. 12 to 14 and the associated description, to which reference is made here. The bags provided in this way with handles in the application unit 8 are then one after the other, and with a small distance from each other, supplied to a schematically represented pair of pressing belts 11, again with the bottoms leading, from where the individual bags are, for example, collected by a known packer and removed.

Due to the fact that the unfinished and the finished carrier bags are moved with their bottom ends leading through the transport means 5 and the pair of pressing belts 11, air that is possibly still present in the bags or carrier bags is squeezed out, so that on the one hand the processing and on the other hand the stacking are simplified considerably.

We claim:

1. A method for manufacturing carrier bags of paper with paper handles glued to outsides of the bags in a continuous working cycle, comprising:

making carrier bags of paper without handles in a bag machine;

and gluing a handle onto the top of each carrier bag in a handle application unit;

feeding the carrier bags from the bag machine to the handle application unit with bottoms of the bags leading, and after the handles have been glued thereto, and moving the bags away from the handle application unit with the bottoms leading.

2. The method according to claim 1, characterized in making paper handles in a handle unit and feeding then to said handle application unit.

3. The method according to claim 1, characterized in messing said carrier bags while they are moved away from the handle application unit.

4. Apparatus for making paper carrier bags with glued on handles comprising:

a bag machine for manufacturing paper carrier bags without handles;

a handle application unit for gluing paper handles onto said carrier bags at the top of each bag;

a transport means for feeding the carrier bags from the bag machine to handle application unit with bottoms of the bags leading; and a removal means for removing the carrier bags from the handle application unit with the bottoms leading.

5. Apparatus according to claim 4, characterized by a handle unit for manufacturing paper handles and for feeding said paper handles to said handle application unit.

6. Apparatus according to claim 4, characterized by a pressing means for pressing the carrier bags removed by said removal means.

7. Apparatus according to claim 4, characterized in that at least one of said removal means and said pressing means consists of a pair of pressing belts.

8. Apparatus according to claim 4, characterized by a transfer station, for transferring said carrier bags from said bag machine to said transport means.

9. Apparatus according to claim 8 wherein said transfer station includes a transfer cylinder.

* * * * *